US008627610B1

(12) United States Patent
Crowther

(10) Patent No.: US 8,627,610 B1
(45) Date of Patent: Jan. 14, 2014

(54) PRIVACY ENCLOSURE

(75) Inventor: Richard H Crowther, Redlands, CA (US)

(73) Assignee: Prime.Line Products Co., Redlands, CA (US)

( * ) Notice: Subject to any disclaimer, the term of this patent is extended or adjusted under 35 U.S.C. 154(b) by 0 days.

(21) Appl. No.: 12/927,192

(22) Filed: Nov. 9, 2010

(51) Int. Cl.
*E06B 9/24* (2006.01)
*E06B 7/00* (2006.01)

(52) U.S. Cl.
USPC ..... 52/32; 52/71; 52/205; 52/211; 52/239; 52/717.01; 49/383; 49/489.1; 16/250

(58) Field of Classification Search
USPC ..... 52/459, 461, 465, 469, 470, 395, 32, 52/36.1, 211, 212, 716.1, 717.01, 65, 71, 52/205, 239, 836; 49/475.1, 493.1, 496.1, 49/383, 399, 462, 384, 489.1, 460; 160/40; 16/224, 227, 250, 262, 266
See application file for complete search history.

(56) References Cited

U.S. PATENT DOCUMENTS

| | | | | |
|---|---|---|---|---|
| 1,221,205 | A | 7/1917 | Moore et al. | |
| 1,259,358 | A | 3/1918 | Carpenter | |
| 1,311,229 | A | 7/1919 | Hughes | |
| 2,776,029 | A | 1/1957 | Hult | |
| 2,933,782 | A * | 4/1960 | Cornell | 49/469 |
| 3,319,697 | A | 5/1967 | Krohn | |
| 3,370,388 | A | 2/1968 | Dielman | |
| 3,390,486 | A | 7/1968 | Walters | |
| 3,646,639 | A | 3/1972 | Burckhardt et al. | |
| 3,827,183 | A | 8/1974 | Zimmerman et al. | |
| 4,261,140 | A | 4/1981 | McLean | |
| 4,388,783 | A | 6/1983 | Logie | |
| 4,555,885 | A * | 12/1985 | Raymond et al. | 52/468 |
| 4,845,892 | A * | 7/1989 | Pinto | 49/383 |
| 4,897,791 | A | 1/1990 | Sekozawa et al. | |
| 5,001,862 | A | 3/1991 | Albenda | |
| 5,076,017 | A | 12/1991 | Jacobs | |
| 5,092,077 | A | 3/1992 | Teinturier-Milgram | |

(Continued)

FOREIGN PATENT DOCUMENTS

| | | | |
|---|---|---|---|
| FR | 2 620 484 | * | 9/1987 |
| GB | 2 259 935 | * | 3/1993 |
| WO | 94/08124 | * | 4/1994 |

OTHER PUBLICATIONS

RBA, Robert Brooks & Associates, Toilet Partition Home Page, pdf Image 1, dtd May 13, 2009.*

(Continued)

*Primary Examiner* — Robert Canfield
(74) *Attorney, Agent, or Firm* — James A. Quinton

(57) ABSTRACT

A privacy enhancer is composed of a first strip preferably rigid and a flexible strip. The first strip has a connector located on one edge. An adhesive is provided along the length of the side for attachment to a first or second pilaster of an enclosure. The enhancer includes a second strip preferably a flexible plastic strip preferably nontransparent having a connector located on an edge of the flexible plastic strip. The two connectors are coupled together. The first strip is then attached to the pilaster by contacting the adhesive side of the strip to the pilaster on the side of the pilaster opposite to the direction of movement of the door. The flexible plastic strip closes off the space between the door and the pilaster when the door is closed.

35 Claims, 10 Drawing Sheets

(56) References Cited

U.S. PATENT DOCUMENTS

| | | | | |
|---|---|---|---|---|
| 5,220,708 | A | 6/1993 | Lucas et al. | |
| 5,263,208 | A * | 11/1993 | Smith | 4/612 |
| 5,419,084 | A | 5/1995 | Sankey et al. | |
| 5,483,771 | A * | 1/1996 | Herbst | 49/504 |
| 5,592,787 | A * | 1/1997 | Ophardt | 52/34 |
| 5,630,302 | A | 5/1997 | Rosenband | |
| 6,058,665 | A | 5/2000 | Halvorson, Jr. et al. | |
| 6,088,966 | A * | 7/2000 | Kenkel | 49/383 |
| 6,357,192 | B1 * | 3/2002 | Schluter | 52/459 |
| 6,434,888 | B1 * | 8/2002 | Shaw et al. | 49/383 |
| 6,550,217 | B2 | 4/2003 | Heung-Bin | |
| 6,622,432 | B2 * | 9/2003 | Zacher et al. | 49/501 |
| 6,643,980 | B1 | 11/2003 | Dorder et al. | |
| 6,796,086 | B2 * | 9/2004 | Albenda | 49/383 |
| 6,859,977 | B2 * | 3/2005 | Morgan et al. | 16/82 |
| 6,931,789 | B2 * | 8/2005 | Stout, Jr. | 49/383 |
| 7,024,823 | B2 | 4/2006 | Keller | |
| 7,987,635 | B2 * | 8/2011 | Thielke et al. | 52/32 |
| 8,074,407 | B2 * | 12/2011 | Sondermann | 52/177 |
| 2003/0205001 | A1 * | 11/2003 | Williams et al. | 49/383 |
| 2005/0108946 | A1 * | 5/2005 | Shaharbani | 49/383 |
| 2006/0101617 | A1 * | 5/2006 | Webb | 16/250 |
| 2007/0151164 | A1 * | 7/2007 | Marshall | 49/397 |
| 2008/0263962 | A1 * | 10/2008 | Wei | 49/462 |
| 2009/0151264 | A1 | 6/2009 | Boens | |
| 2010/0088962 | A1 * | 4/2010 | McRoskey | 49/303 |
| 2010/0101149 | A1 | 4/2010 | Keller | |
| 2010/0257788 | A1 * | 10/2010 | McRoskey | 49/383 |
| 2012/0175065 | A1 * | 7/2012 | Mayzum | 160/24 |

OTHER PUBLICATIONS

RBA, Robert Brooks & Associates, Toilet Partition Home Page, pdf Image 2, dtd May 13, 2009.*

* cited by examiner

PRIVACY ENCLOSURE

FIELD OF THE INVENTION

The field of the invention is privacy enclosures and a privacy enhancer to increase the privacy of privacy enclosures.

BACKGROUND OF THE INVENTION

Privacy enclosures for use as restroom or changing rooms are well known in the art. Public bathroom privacy panels have been in existence since 1920. See U.S. Pat. Nos. 1,311,229 (Hughes) 1,221,205 (Moore), and 1,259,358 (Carpenter). The modern restroom partition system was developed by Hult in about 1957. See U.S. Pat. No. 2,776,029 (Hult). This system utilized metal panels that attached to the walls and floor using specialized brackets, and the doors used specialized hinges. Today most partition systems are based on the Hult design. These systems are manufactured by large factories that specialize in steel fabrication, welding, painting, and Formica lamination. These manufacturers custom build the assemblies to architectural specifications. The enclosures are delivered to job sites and installed with minor assembly. A common feature of the partition systems is on how the doors work. Typically hinged doors allows for perimeter gaps at the jamb sides 1 inch or more when the door is closed. These gaps can provide for loss of privacy to the user. There is a need in the art to enhance the privacy afforded by such enclosures.

SUMMARY OF THE INVENTION

According to the invention a privacy enhancer that can be applied to existing privacy and to new enclosures is provided. In another aspect of the invention, a privacy enclosure is provided which affords improved privacy.

The invention is desirably used in a privacy enclosure such as a public restroom or a fitting room in a clothing store. The enclosure typically has a back wall and sidewalls connected to the back wall. Opposed pilasters are connected to the sidewalls of the enclosure. The enclosure has an entrance defined by spaced apart pilasters and a swinging door mounted to one of the pilasters by hinges to close off the entrance and provide privacy. A latch is provided on the door for engagement with a keeper provided on the other pilaster to securely close the door. A narrow space is formed between the hinged door and the first pilaster that allows viewing of the interior of the enclosure from the outside. The latch side of the door has a narrow space between the door and the pilaster that also allows viewing of the interior of the enclosure from the outside. According to the invention, the spaces are attractively closed off to enhance privacy of the enclosure in use.

According to the invention a privacy enhancer for public privacy enclosures is provided. The enhancer is composed of a first strip preferably rigid and a flexible plastic strip preferably nontransparent. The first strip has a connector preferably located on one edge that desirably extends along the length of the edge of the strip. On one side of the strip, an adhesive is provided desirably along the length of the side for attachment to a first or second pilaster of an enclosure having an entrance defined by the first and second pilaster and a swinging door. The door opens in a predetermined direction. The enclosure has a space between the first and second pilaster and the door when the door is closed as described above.

The enhancer includes a second strip preferably a flexible plastic strip preferably nontransparent having a connector preferably located on an edge of the flexible plastic strip. The two connectors are coupled together to form a unitary strip.

The first strip is then attached to the pilaster by contacting the adhesive side of the strip to the pilaster on the side of the pilaster opposite to the direction of movement of the door. The flexible strip preferably nontransparent plastic strip closes off the space between the door and the pilaster when the door is closed to block visual inspection of the inside of the privacy enclosure in use without restricting movement of said door.

The preferred embodiment of the present invention is illustrated in the drawings and examples. However, it should be expressly understood that the present invention should not be limited solely to the illustrative embodiment

DETAILED DESCRIPTION OF THE INVENTION

Figure 1:
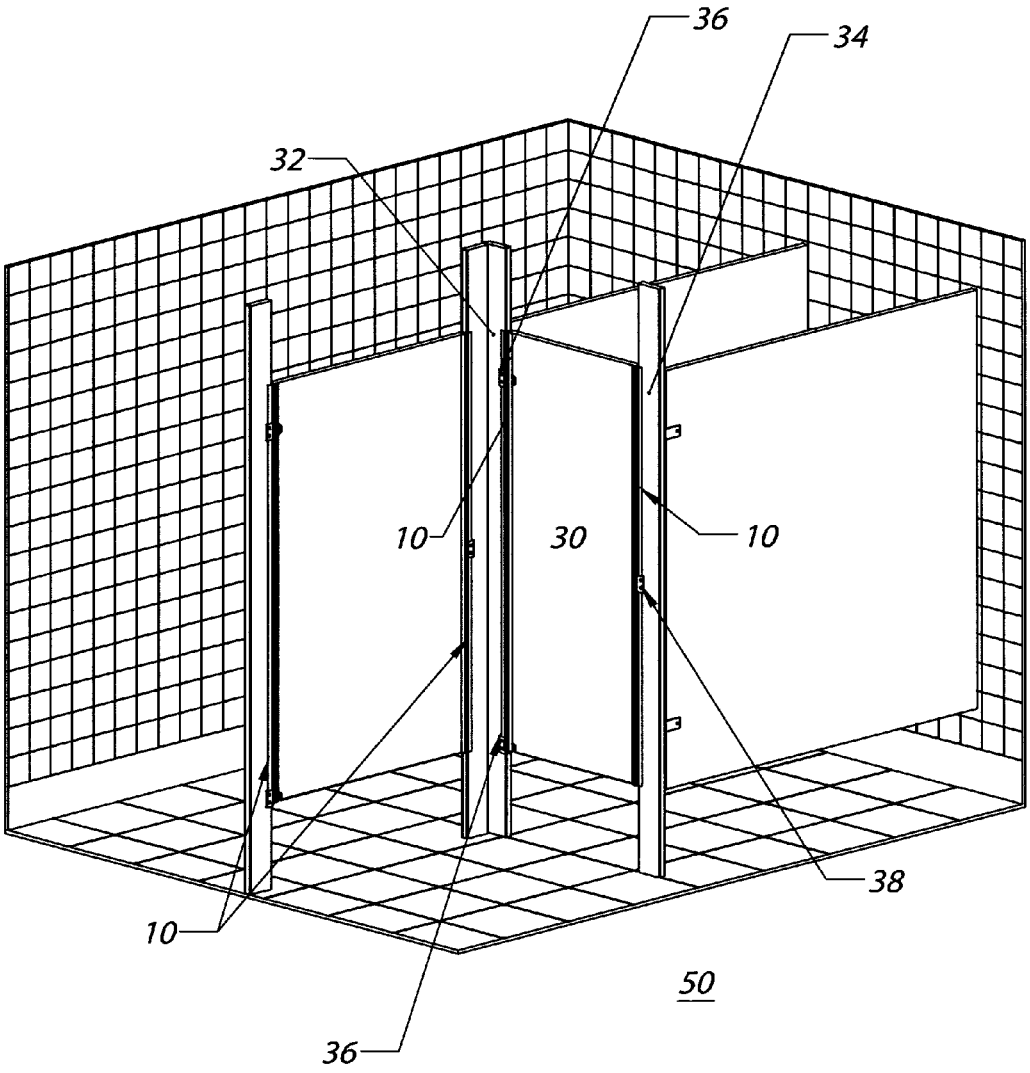
FIG. 1 is a perspective view of a bathroom stall with the privacy enhancers according to the invention installed.

According to the invention a privacy enhancer that can be applied to existing privacy enclosures preferably a public restroom optionally a dressing or fitting room for trying on clothing in a store is provided. In another aspect of the invention, a privacy enclosure is provided which affords improved privacy. Preferably the privacy enclosure is a public restroom. Optionally the privacy enhancer can be installed during construction of the privacy enhancer. The enclosure can be made of a variety of materials for example steel, stainless steel, formica and the like.

The enclosure preferably a restroom stall typically has a back wall and sidewalls connected to the back wall. Opposed pilasters are connected to the sidewalls of the enclosure. The enclosure has an entrance defined by spaced apart pilasters and a swinging door mounted to one of the pilasters by hinges to close off the entrance and provide privacy. A latch is provided on the door for engagement with a keeper provided on the other pilaster to securely close the door. A narrow space is formed between the hinged door and the first pilaster that allows viewing of the interior of the enclosure from the outside. When the door is closed, the latch side of the door has a narrow space between the door and the pilaster that also allows viewing of the interior of the enclosure from the outside. According to the invention, these spaces are attractively closed off to enhance privacy of the enclosure in use.

According to the invention, a privacy enhancer for public privacy enclosures preferably public restrooms is provided. The enhancer is composed of a first strip and a flexible strip. The first strip is preferably a rigid strip desirably a plastic strip optionally a metal strip for example a rigid vinyl strip, or a steel strip. The first strip is preferably clear or semi-clear rigid vinyl. Such a clear vinyl allows the natural color or finish of the pilaster to show through which makes the enhancer blend in with the pilaster to be unobtrusive. The flexible plastic strip is preferably nontransparent plastic desirably a flexible vinyl strip. The first strip has a connector located on one edge that preferably extends along the length of the edge of the strip. On one side of the first strip, an adhesive is provided preferably along the length of the side for attachment to a first or second pilaster of an enclosure having an entrance defined by the first and second pilaster and a swinging door. Desirably a privacy enhancer is attached to both pilasters. Desirably a two sided adhesive tape is used for example 3M 300L SE can be used with steel pilasters. Desirably the tape includes a removable top layer which when removed exposes a contact adhesive to adhere the privacy enhancer to the pilaster. In selecting the adhesive, one should chose an adhesive that forms a substantially permanent attachment to the material of the pilaster and preferably to a variety of pilaster materials such as painted steel, flat or embossed stainless steel, laminate, solid plastic and phenolic materials. The door opens in a predetermined direction either into the enclosure or outward. The enclosure normally has a space between the first and second pilaster and the door on both sides when the door is closed as described above.

The enhancer includes a second strip preferably a flexible plastic strip desirably nontransparent preferably vinyl having a connector located on an edge of the flexible nontransparent plastic strip. Desirably the connector extends the entire length of the second strip. As used herein nontransparent means an opaque strip which does not transmit light, or a diffusing strip which transmits some light but diffuses the light sufficiently so that objects inside of the enclosure are not discernable from outside of the enclosure. For example a diffusing strip is desirably a smoked or cloudy vinyl that transmits some light but obscures any image.

Optionally the flexible strip can be extruded with serrations along the length of the strip. The color and the serrations serve to further obscure visibility into the privacy enclosure. The flexible nature allows the strip to be pushed by the door. As a result, movement of the door is not substantially restricted by the privacy enhancer.

The two strips are coupled together to desirably to form the unitary privacy enhancer. The enhancer is attached to the pilaster by contacting the adhesive side of the first strip to the pilaster on the side of the pilaster opposite the direction of movement of the door. Thus, the enhancer is applied to the side of the pilaster opposite to the opening direction of the door. Thus, if the door opens outward, the privacy enhancer is placed on the inside of the pilaster. If the door opens inward, the privacy enhancer is placed on the outside of the pilaster. This insures the personal privacy of the patron and will not cause any binding or inhibition in the closing of the door. It is usually necessary to cut the enhancer to fit around hinges on the one side and around keepers and strikes on the other side. Cutting the enhancer is easily accomplished by using (diagonal) pliers or (universal) snips, or other cutting device particularly when the first and second strips are vinyl.

When the enhancer is installed, the second strip closes off the space between the door and the pilaster when the door is closed to block visual inspection of the inside of the privacy enclosure in use without restricting movement of the door. Desirably an enhancer is installed on both sides of the door that is on both the hinge side and the latch side. The second strip can be made from a variety of materials that are flexible and preferably substantially nontransparent. Desirably a flexible vinyl preferably a smoked flexible vinyl is used. The flexible vinyl strip can be produced using 'smoke' or gray colored semi-opaque material. The flexible strip can be extruded with serrations or ribs along the length of the strip to further obstruct viewing inside the privacy enclosure. The color and the serrations or ribs serve to further obscure visibility into the privacy enclosure. The flexible strip allows use in situations where various methods of hinging the door are used, such as surface mounted hinges and gravity pivot hinges. Desirably the flexible plastic strip is arch shaped. This reduces the possibility of drag on the door as it is opened and closed. The resulting privacy enhancer is simple to install and fastener free. Installation can be performed without the need for most tools, with the exception of a measuring tape, pencil, appropriate cleaning solvent (isopropyl—rubbing alcohol) and the cutting tool of one's choice to cut the enhancer to fit the enclosure.

Figure 2:
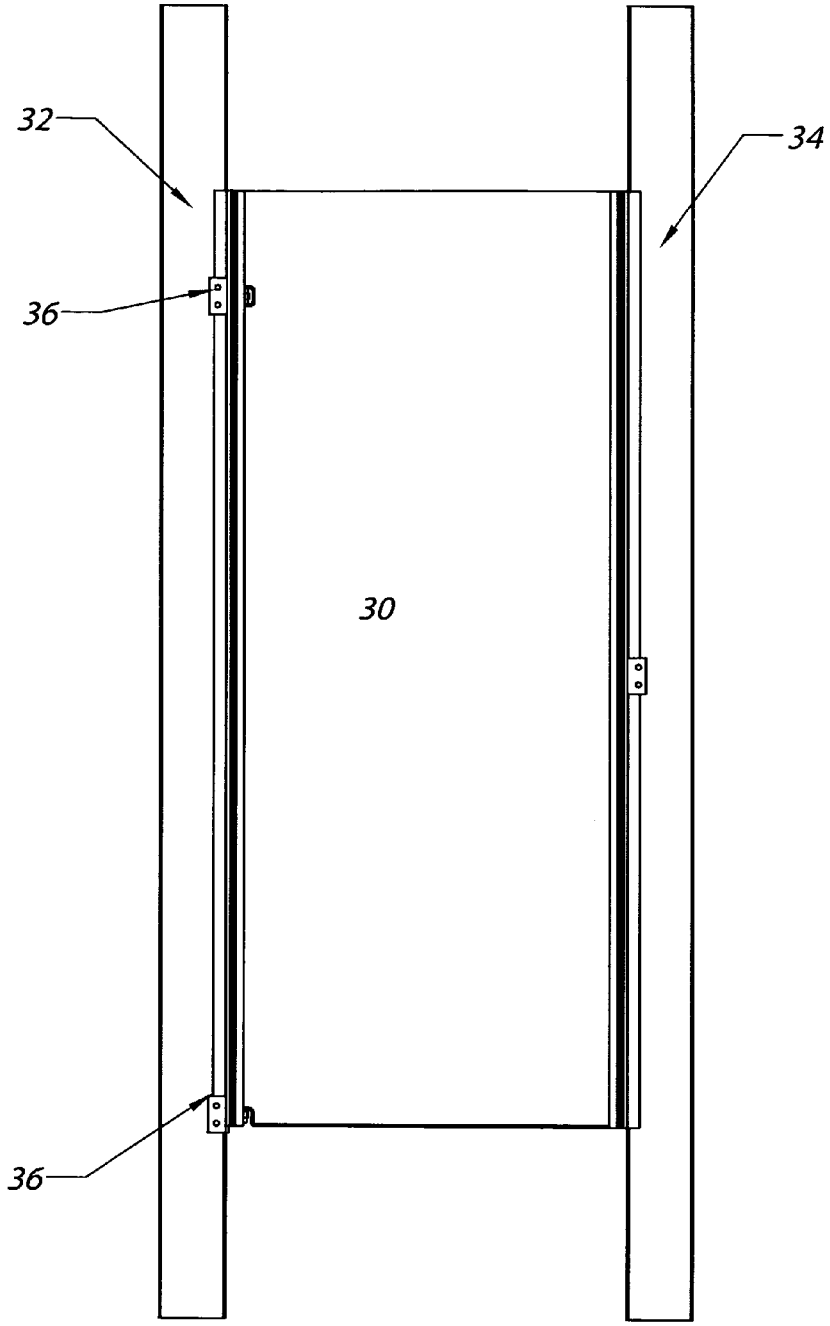
FIG. 2 is a front view of the door of FIG. 1.
Figure 3:
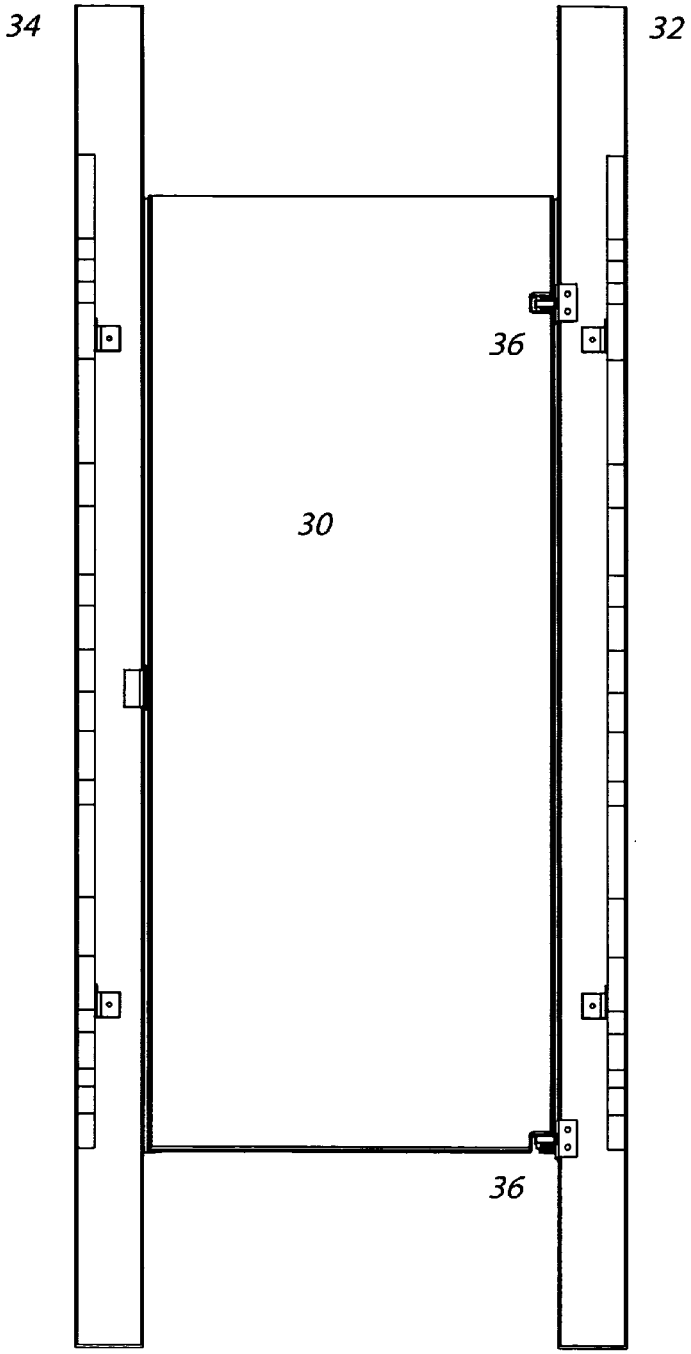
FIG. 3 is a rear view of FIG. 2.
Figure 4:
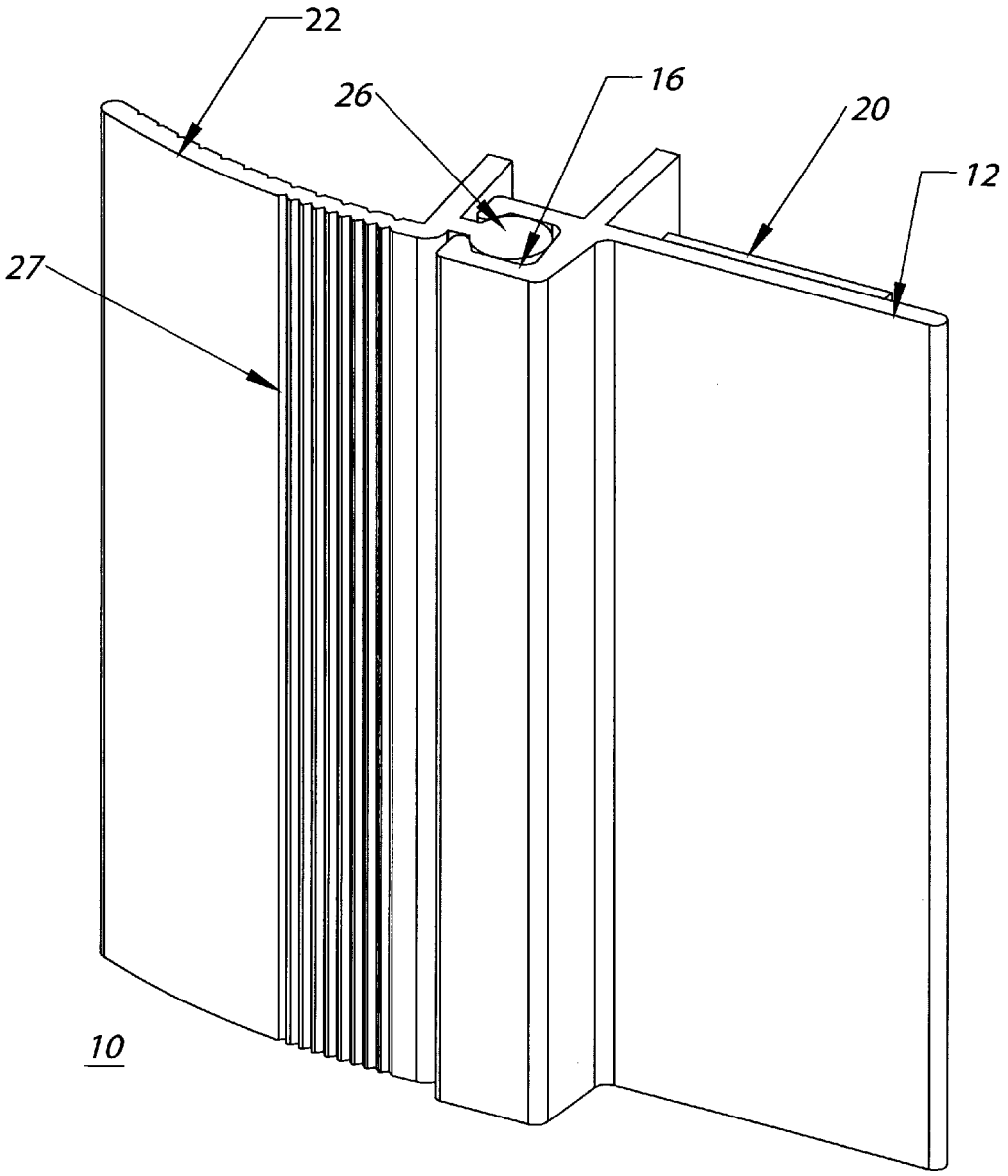
FIG. 4 is a perspective view of the privacy enhancer according to the invention looking from the front.
Figure 5:
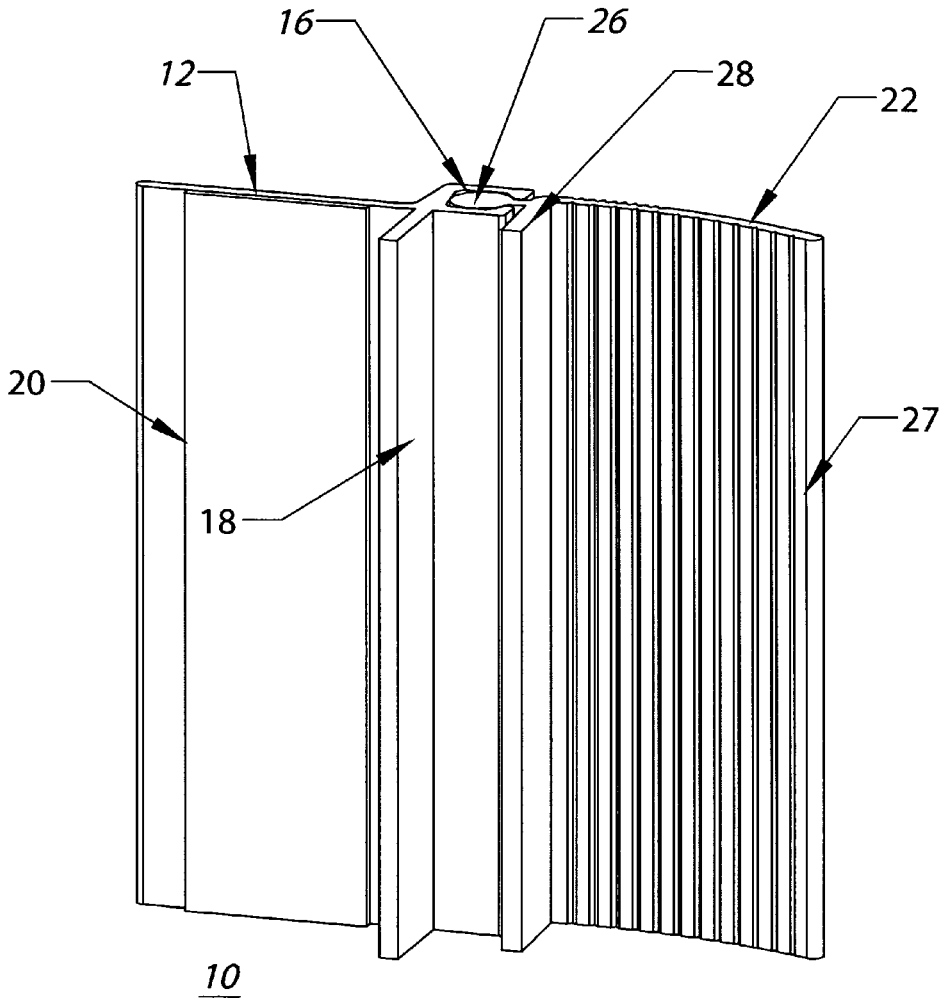
FIG. 5 is a perspective view of the privacy enhancer of FIG. 4 looking from the back.
Figure 6:
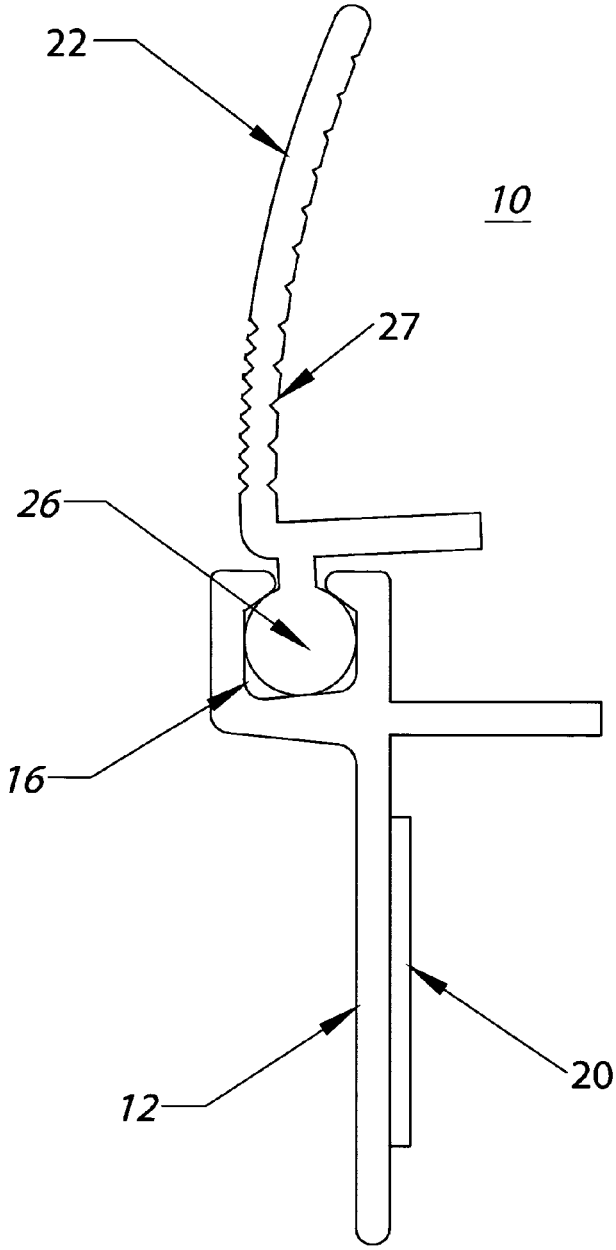
FIG. 6 is a top view of the privacy enhancer of FIG. 4.
Figure 7:
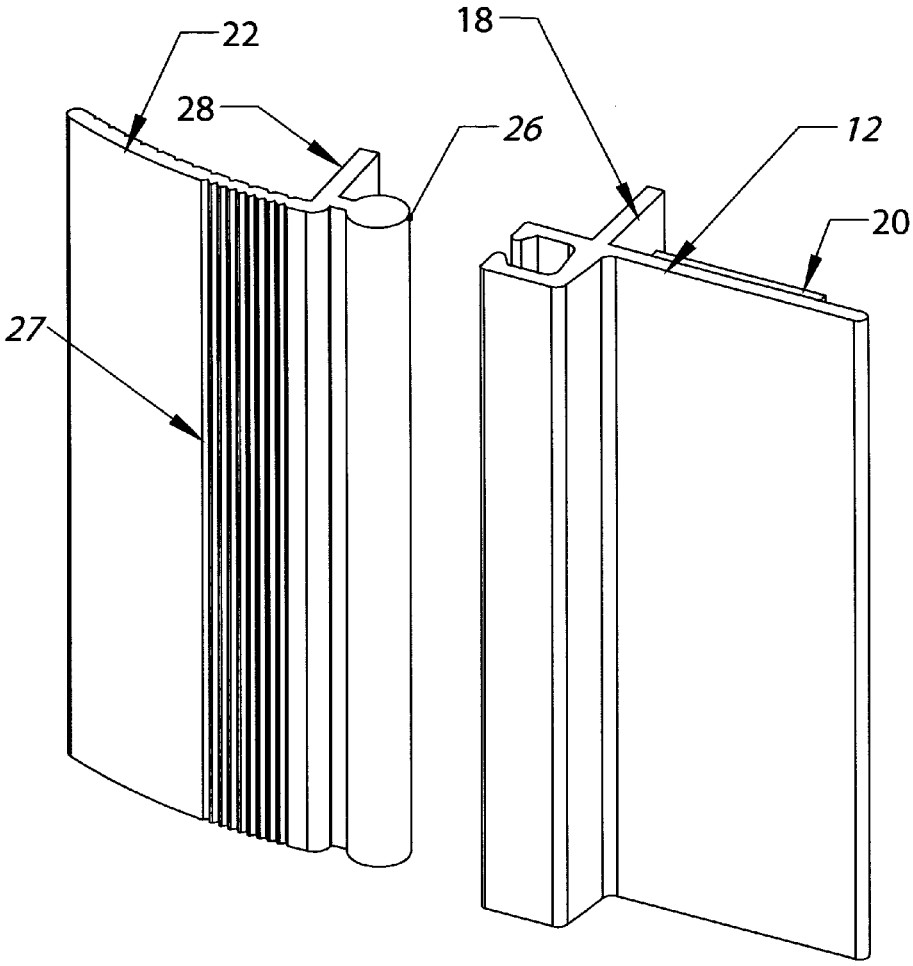
FIG. 7 is a perspective view of the privacy enhancer of FIG. 4 prior to assembly.
Figure 8:
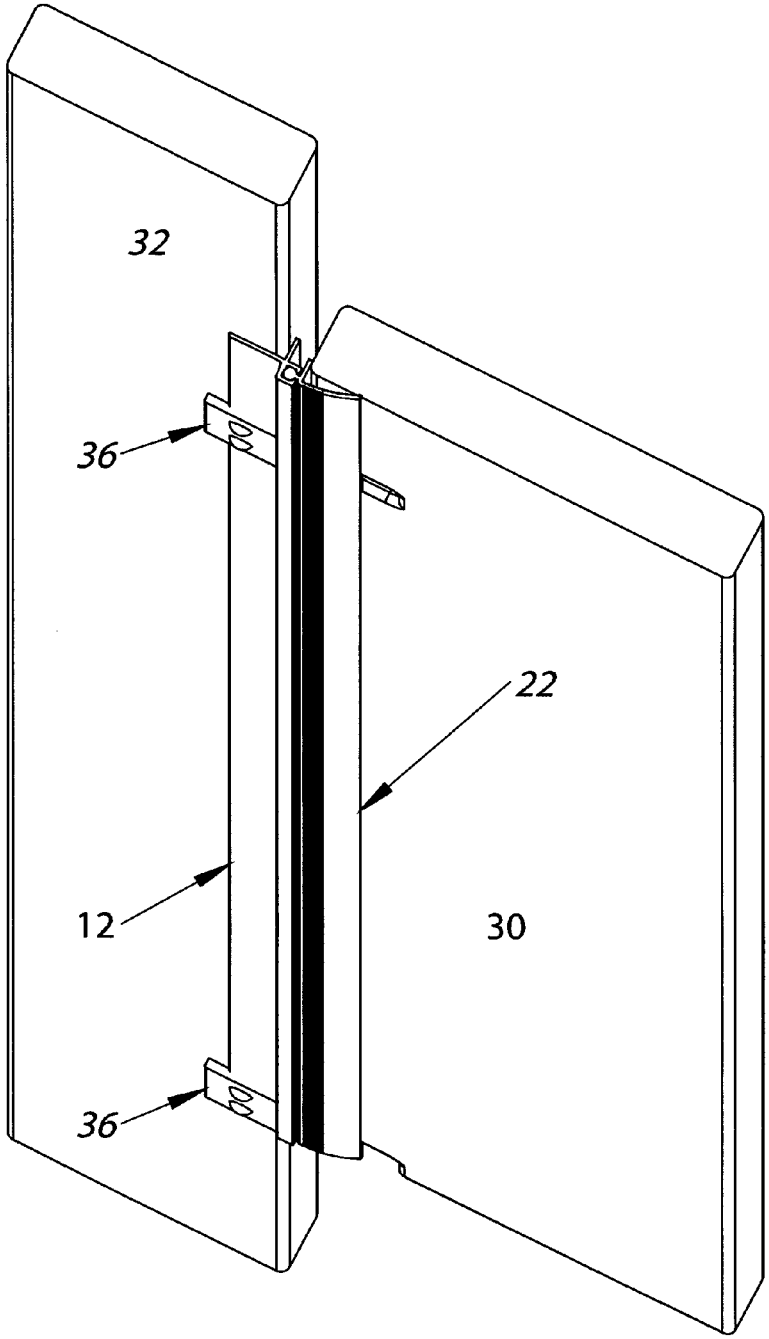
FIG. 8 is a partial perspective view of the privacy enhancer according to the invention installed on the hinge side of a privacy enclosure.
Figure 9:
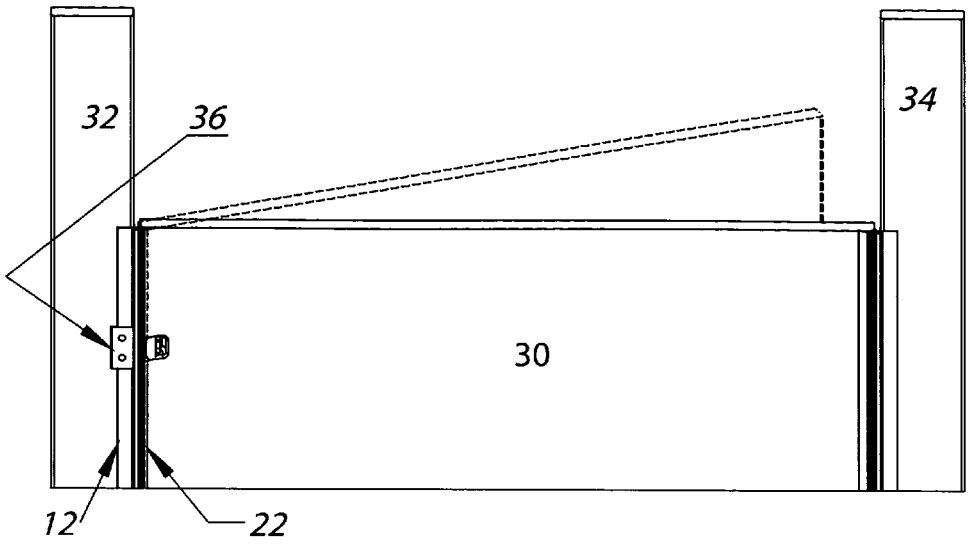
FIG. 9 is a partial perspective view of the privacy enhancer according to the invention installed on the left and right sides of a privacy enclosure.
Figure 10:
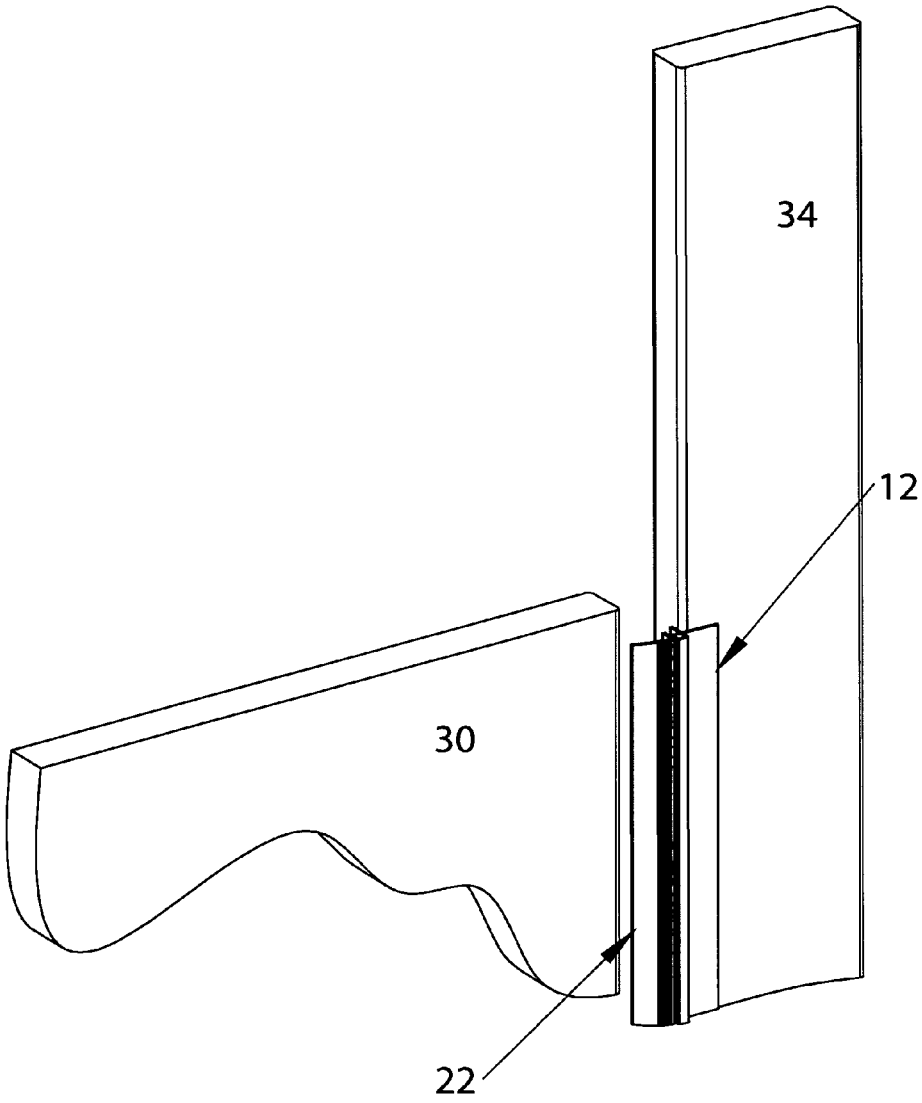
FIG. 10 is a partial perspective view of the privacy enhancer according to the invention installed on the door side of a privacy enclosure.

Referring now to the figures as best seen in FIGS. 1 to 10, a privacy enhancer 10 according to the invention for public privacy enclosures preferably public restroom 50 is provided. The enhancer 10 is composed of a first strip preferably a rigid strip desirably a plastic strip optionally a metal strip preferably rigid clear vinyl strip 12 connected to a flexible strip preferably a substantially nontransparent plastic desirably a vinyl strip 22. As best seen in FIGS. 4-7, the first strip preferably rigid strip 12 has a connector desirably a c-channel 16 located on an edge of strip 12 that extends along the length of strip 12. Leg 18 extends perpendicularly from the first strip 12 and is provided to give added structural rigidity to channel 16. Leg 18 also aids in physically positioning the enhancer with reference to the pilaster in installation.

On one side of the first strip 12, an adhesive is provided preferably along the length of the side for attachment to a first (left side) pilaster 32 or a second (right side) pilaster 34 of restroom 50 having an entrance defined by the first 32 and second pilaster 34 and a swinging door 30. Desirable an enhancer 10 is affixed to both pilasters 32 and 34. Desirably a two sided adhesive tape 20 is used for example 3M 300L SE as the adhesive. Desirably the tape includes a removable top layer which when removed exposes a contact adhesive to adhere the privacy enhancer to the pilaster. In selecting the adhesive, one should chose an adhesive that forms a substantially permanent attachment to a variety of partition post materials such as painted steel, flat or embossed stainless steel, laminate, solid plastic and phenolic material and certainly it must adhere to the specific material of the pilasters. The door 30 opens in a predetermined direction either inward into the enclosure or outward out of the enclosure preferably inward. The enclosure normally has a first space between the first pilaster 32 and door 30 and a second space between the second pilaster 34 and the door 30 when the door 30 is closed.

The privacy enhancer 10 includes a second strip preferably a flexible plastic strip desirably a nontransparent vinyl strip 22 having a connector desirably rod 26 located on an edge of the flexible nontransparent plastic strip 22 for mating engagement in c-channel 16 of first strip 12. Desirably a ball joint is formed between the c-channel 16 and rod 26. Preferably strip 22 is an arch shaped diffusing strip desirably a smoked vinyl desirably having serrations 27 or ribs along the length of the strip. Leg 28 is provided adjacent rod 26 of strip 22 to provide a clearance under rod 26 to allow pivoting so the movement of door 30 is substantially unimpeded.

The mating connectors 26 and 16 are coupled together by sliding rod 26 into channel 16 to desirably form a unitary strip. The channel 16 is preferably c-shaped. Rod 26 slides into channel 16 at the bottom. The C-shaped top of the channel 16 locks the rod 26 in the channel 16 and prevent removal of the rod from the top. During manufacture, rod 26 is desirably pushed into channel 16 then the pieces are run through a roll former or crimper that sets the rigid plastic strip 12 and crimps it onto flexible strip 22. This creates a slight blush as the rigid plastic is forced formed. Alternatively the first and second strips are co-extruded both at one time. Preferably the rod 26 and channel 16 form a ball joint.

The privacy enhancer 10 is attached by removing the protective covering from the adhesive and contacting the adhesive side 20 of the first strip 12 to a pilaster by on the side of the pilaster opposite the direction of opening movement of the door. See FIGS. 9 and 10. The privacy enhancer 10 is applied to the side of the pilaster 32 or 34 or both opposite to the opening direction of the door 30. This insures the personal privacy of the patron and will not cause any binding or inhibition in the closing of the door 30. It usually will be necessary to cut the privacy enhancer 10 to fit around hinges 36 on the one side and around keepers 38 and/or strikes on the other side. This does not affect the primary purpose of this product namely enhancing privacy of the user. Cutting the vinyl of enhancer is easily accomplished by using (diagonal) pliers or (universal) snips, or other suitable cutting device.

Installed the second strip 22 closes off the spaces between the door 30 and the pilaster 32 and 34 when the door 30 is closed to block visual inspection of the inside of the privacy enclosure in use without restricting movement of the door. Desirably a privacy enhancer 10 is installed on both sides of the door that is on both the hinge side and the latch side. The privacy enhancer is simple to install and fastener free. Installation can be performed without the need for most tools, with the exception of a measuring tape, pencil, appropriate cleaning solvent (isopropyl—rubbing alcohol) and the cutting tool of one's choice to cut the enhancer to fit the enclosure. Since strip 22 is flexible, the door can be freely closed. Since strip is nontransparent, the privacy of the occupant is protected.

The foregoing is considered as illustrative only to the principals of the invention. Further, since numerous changes and modification will occur to those skilled in the art, it is not desired to limit the invention to the exact construction and operation shown and described above, and accordingly, all suitable modifications and equivalents may be resorted to, falling within the scope of the invention.

The invention claimed is:

1. A privacy enhancer for public privacy enclosures comprising:

a) a first strip;

b) a first connector located on an edge of said first strip;

c) said first strip having an adhesive along one side for attachment to a first or second pilaster of an enclosure having an entrance defined by the first and second pilaster and a swinging door; said door opening in a predetermined direction; said enclosure having a space between said first and second pilaster and said door when said door is closed;

d) a flexible strip having a first end and a second end remote from said first end; a second connector located on the outer edge of said first end of said flexible strip; said second end of said flexible strip movable when contacted by said door when said door is closed without inpeading the movement of said door;

e) said second connector coupled with said first connector to connect said first strip to said flexible strip;

f) said first strip attached on a side of a pilaster opposite said predetermined opening direction of said door;

g) said flexible strip closing off said space when said door is closed without restricting movement of said door;

whereby the privacy of said enclosure from visual inspection from the outside is improved without impeding the movement of said door.

2. The privacy enhancer according to claim 1 wherein said first strip is rigid.

3. The privacy enhancer according to claim 2 wherein said first strip is rigid plastic.

4. The privacy enhancer according to claim 2 wherein said first strip is metal.

5. The privacy enhancer according to claim 2 wherein said first strip is clear.

6. The privacy enhancer according to claim 2 wherein said adhesive extends the length of said first strip.

7. The privacy enhancer according to claim 2 wherein said flexible strip is plastic.

8. The privacy enhancer according to claim 7 wherein said flexible strip is vinyl.

9. The privacy enhancer according to claim 1 wherein said flexible strip is nontransparent.

10. The privacy enhancer according to claim 1 wherein said flexible strip is opaque.

11. The privacy enhancer according to claim 8 wherein said flexible strip is smoke colored.

12. The privacy enhancer according to claim 7 wherein said flexible strip is a diffusing strip.

13. The privacy enhancer according to claim 7 further comprising said flexible strip has serrations.

14. The privacy enhancer according to claim 7 wherein:

said first connector having a channel extending from one edge of said first strip;

said flexible strip having one or more projections along an edge of said flexible strip;

said channel receiving said one or more of said projections to securely couple said flexible strip to said first strip.

15. The privacy enhancer according to claim 14 wherein said channel is a c-channel.

16. The privacy enhancer according to claim 15 wherein said one or more projections is a rod extending substantially the entire length of said flexible strip for snug engagement by said c-channel.

17. The privacy enhancer according to claim 16 wherein said flexible strip is arch shaped.

18. The privacy enhancer according to claim 2 further comprising a rib extending perpendicularly from said first strip between said first strip and said first connector to provide structural rigidity for said first connector.

19. The privacy enhancer according to claim 2 further comprising said first strip and said flexible strip are plastic and are co-extruded.

20. A privacy enclosure comprising:

a) a back wall and a front;

b) a first side wall and a second side wall connected to said back wall;

c) a first pilaster connected to said first side wall and a second pilaster connected to said second side wall to form the front of said enclosure;

d) said first and second pilaster spaced apart to provide an opening in said enclosure;

e) a door having a hinged side and a free side; said back wall, said door said first and second side wall enclosing an interior space;

f) said door mounted to said first pilaster on said hinged side by hinges to form a first narrow space between said hinged door and said first pilaster which allows viewing of the interior space of said enclosure from the outside;

g) said door opening in a predetermined direction;

h) said door free side interacting with a keeper mounted to said second pilaster;

i) said door forming a second narrow space between said door and said second pilaster when said door is closed which allows viewing of the interior space of said enclosure from the outside;

j) a privacy enhancer attached to said first pilaster, said second pilaster or both pilasters on the side opposite the direction of opening movement of said door comprising;

k) i) a first strip;

ii) said first strip having a channel extending from one edge thereof;

iii) said channel extending along the length of said edge of said strip;

iv) said first strip having an adhesive along the length of one side of said first strip;

v) a flexible nontransparent plastic strip having a projection along an edge of said flexible nontransparent plastic strip;

vi) said channel receiving said projection to securely couple said flexible nontransparent strip to said first strip.

21. The privacy enhancer according to claim 20 wherein a privacy enhancer is attached to both said first and said second pilasters.

22. The privacy enhancer according to claim 20 further comprising said first strip is rigid plastic.

23. The privacy enhancer according to claim 20 further comprising said first strip is metal.

24. The privacy enhancer according to claim 20 wherein:

said flexible nontransparent plastic strip having one or more projections along an edge of said flexible nontransparent plastic strip;

said channel receiving said one or more projections to securely couple said flexible nontransparent plastic strip to said first strip.

25. The privacy enhancer according to claim 20 wherein said one or more projections is a rib extending substantially the entire length of said flexible nontransparent plastic strip for snug engagement by said channel.

26. The privacy enhancer according to claim 20 wherein said channel is a c-channel.

27. The privacy enhancer according to claim 26 wherein said one or more projections is a rod.

28. The privacy enhancer according to claim 20 further comprising a leg extending perpendicularly from said first strip between said strip and said connector to provide structural rigidity for said channel.

29. The privacy enhancer according to claim 20 wherein said flexible nontransparent plastic strip is opaque.

30. The privacy enhancer according to claim 20 wherein said flexible nontransparent plastic strip is light diffusing strip.

31. The privacy enhancer according to claim 20 wherein said flexible nontransparent plastic strip is a vinyl strip.

32. The privacy enhancer according to claim 20 wherein said flexible nontransparent plastic strip is a smoked vinyl strip.

33. The privacy enhancer according to claim 20 wherein said flexible nontransparent plastic strip is arch shaped.

34. The privacy enhancer according to claim 20 further comprising said first strip is plastic and said flexible nontransparent plastic strip and said first strip are co-extruded.

35. The privacy enhancer according to claim 20 wherein said first strip is clear.

* * * * *